US012109470B1

(12) United States Patent
Skacan

(10) Patent No.: US 12,109,470 B1
(45) Date of Patent: Oct. 8, 2024

(54) MODULAR MINI-GOLF OBSTACLE KIT

(71) Applicant: Cody J. Skacan, Severna Park, MD (US)

(72) Inventor: Cody J. Skacan, Severna Park, MD (US)

( * ) Notice: Subject to any disclaimer, the term of this patent is extended or adjusted under 35 U.S.C. 154(b) by 0 days.

(21) Appl. No.: 18/652,487

(22) Filed: May 1, 2024

Related U.S. Application Data

(60) Provisional application No. 63/463,156, filed on May 1, 2023.

(51) Int. Cl.
*A63B 67/02* (2006.01)

(52) U.S. Cl.
CPC ..... *A63B 67/02* (2013.01)

(58) Field of Classification Search
CPC ..... A63B 67/02
See application file for complete search history.

(56) References Cited

U.S. PATENT DOCUMENTS

| | | | | |
|---|---|---|---|---|
| 1,894,061 A | | 1/1933 | Sanders | |
| 2,558,591 A | | 6/1951 | Starck | |
| 2,626,152 A | | 1/1953 | Miller | |
| 2,907,137 A | | 10/1959 | Ehrmann | |
| 3,690,674 A | * | 9/1972 | Taylor | A63B 57/357 473/163 |
| 3,701,214 A | | 10/1972 | Sakamoto | |
| 4,447,059 A | | 5/1984 | Czajkowski | |
| 5,042,813 A | | 8/1991 | Huang | |
| 5,251,900 A | | 10/1993 | Gallant | |
| 5,746,038 A | | 5/1998 | Houk | |
| 5,791,114 A | | 8/1998 | Mandel | |
| 5,947,787 A | | 9/1999 | Cyrus et al. | |
| 6,428,420 B1 | * | 8/2002 | Durnell | A63B 67/02 473/162 |
| 6,669,572 B1 | | 12/2003 | Barlow | |
| 6,672,971 B2 | | 1/2004 | Barlow | |
| 7,516,587 B2 | | 4/2009 | Barlow | |
| 7,744,479 B2 | | 6/2010 | Whitfield | |

(Continued)

FOREIGN PATENT DOCUMENTS

| | | |
|---|---|---|
| DE | 1945024 A1 | 3/1971 |
| DE | 2547637 A1 | 4/1977 |

(Continued)

OTHER PUBLICATIONS

13 Pcs Kids Golf Set Mini Wooden Toddler Golf Set for Kids 3-12 Age Includes 2 Golf Clubs, 2 Balls, 4 Orifice Plates, 2 Slopes, 2 Holes and Storage Bag for Christmas, Dekin, downloaded Dec. 6, 2023 from https://www.amazon.com/Toddler-Orifice-Storage-Christmas-Outdoor/dp/B0B9BVBZDP.

(Continued)

*Primary Examiner* — Joshua T Kennedy
(74) *Attorney, Agent, or Firm* — U. Maryland Balt. Carey School of Law MIPLRC/IPEC

(57) ABSTRACT

A modular mini-golf obstacle kit to allow individual creativity by enabling users to design their own miniature golf hole. The kit may have a number of various types of pieces and obstacles, each including uniform connecting mechanisms so that the pieces can interlock with one another in a variety of combinations. This allows for flexibility in design so each user can construct their own perfect mini golf hole anywhere they take the kit.

10 Claims, 4 Drawing Sheets

(56) References Cited

U.S. PATENT DOCUMENTS

| | | | | |
|---|---|---|---|---|
| D657,827 | S | 4/2012 | Mimlitch, III et al. | |
| D713,474 | S | 9/2014 | Roberson et al. | |
| D714,400 | S | 9/2014 | Jensen | |
| 9,364,769 | B2 | 6/2016 | Kosmo | |
| 10,188,961 | B1 | 1/2019 | Lee et al. | |
| 10,463,936 | B1 * | 11/2019 | Lanuti | A63B 67/02 |
| D887,023 | S | 6/2020 | Felix | |
| D977,581 | S | 2/2023 | Bond | |
| 2002/0169027 | A1 * | 11/2002 | Fowler | A63B 67/02 473/157 |
| 2003/0096657 | A1 | 5/2003 | Knox | |
| 2004/0203314 | A1 | 10/2004 | Effler | |
| 2007/0042829 | A1 | 2/2007 | Dennesen | |
| 2008/0274817 | A1 * | 11/2008 | Gibbons | A63B 67/02 473/196 |
| 2009/0181782 | A1 | 7/2009 | Knox | |
| 2009/0186716 | A1 * | 7/2009 | Lancia | A63B 67/02 473/157 |
| 2009/0320390 | A1 | 12/2009 | Kolozsvari et al. | |
| 2010/0109247 | A1 | 5/2010 | Cernansky | |
| 2019/0184254 | A1 | 6/2019 | Hamilton | |
| 2019/0308094 | A1 * | 10/2019 | Van Arsdale | A63B 69/3655 |
| 2023/0149827 | A1 | 5/2023 | Engelhard | |
| 2023/0383478 | A1 * | 11/2023 | Ross | E01C 13/08 |

FOREIGN PATENT DOCUMENTS

| | | | | |
|---|---|---|---|---|
| DE | 8703680 | U1 | 4/1987 | |
| DE | 19614273 | C1 | 6/1997 | |
| DE | 202004000005 | U1 | 2/2005 | |
| DE | 202019106433 | U1 * | 2/2020 | |
| FR | 990651 | A | 9/1951 | |
| FR | 2559175 | A1 * | 2/1984 | |
| GB | 2343632 | A * | 5/2000 | A63B 67/02 |
| KR | 200425240 | Y1 | 9/2006 | |
| KR | 20220142231 | A | 10/2022 | |
| WO | WO2004098729 | A1 | 11/2004 | |

OTHER PUBLICATIONS

Mini Golf Xylophone Ramp, FM_EZRA6_1, Feb. 12, 2017, UltiMaker Thingiverse, downloaded Dec. 7, 2023 from https://www.thingiverse.com/thing:2105726.

Mini Golf Hole, Dec., 22, 2021, UltiMaker Thingiverse, K-EYE, downloaded Dec. 7, 2023 from https://www.thingiverse.com/thing:5171744.

Micro Golf—Pro Starter Kit, Oonker, downloaded Mar. 5, 2024 from https://www.etsy.com/listing/1474472820/micro-golf-pro-starter-kit.

Plakks, Pitch & Plakks, downloaded Dec., 7, 2023 from https://gamersguildaz.com/products/pitch?variant=41570613919949 and https://plakks.com/products/pitch-plakks.

Minigolf Obstacles—basic set, Stoa-Games, downloaded Mar. 5, 2024 from https://www.stoa-games.com/en/garden-minigolf/minigolf-obstacles-basic/.

Toy Outdoor Golf Game Playset—15pc—Hearth & Hand™ with Magnolia, Target.com, downloaded Dec. 7, 2023 from https://www.target.com/p/toy-outdoor-golf-game-playset-15pc-hearth-38-hand-8482-with-magnolia/-/A-86970360.

* cited by examiner

MODULAR MINI-GOLF OBSTACLE KIT

CROSS REFERENCE TO RELATED APPLICATIONS

This application claims the benefit of U.S. patent application Ser. No. 63/463,156, filed May 1, 2023, the contents of which are hereby incorporated by reference.

BACKGROUND OF INVENTION

Many people across the world play golf. Golf courses have risen in popularity, and along with them, have come mini golf courses. These are often a smaller version designed for putting, typically with some aspect of whimsical design and obstacles. At some point, brushing up on golf skills at home became popular through putting green pads. While people can practice their putting in a classic fashion, there largely has not been the same ability to play mini golf at home. By having the ability to create your own mini golf course-barriers, obstacles, and all—this could change. The industry could be changed as people could enjoy the pleasure of a mini golf game that they get to design from the comfort of their home, or anywhere they choose to bring it.

SUMMARY OF INVENTION

In some aspects, the techniques described herein relate to a modular miniature golf course obstacle kit for assembly on a playing surface including: a ramp element generally of prism shape having: an incline surface having a top level edge, a first side edge, a second side edge, and a base edge for contacting with the playing surface, a back, a base, oppositely disposed sides, a plurality of base receiving sockets disposed in the base adjacent to each side and to the back, a plurality of vertical receiving sockets disposed on each side adjacent to the back, a plurality of top level receiving sockets disposed at the top level edge adjacent to the back, a curb along the first side edge, and a curb along the second side edge; a wedge element generally of prism shape smaller than the ramp element and having a base edge for contacting with the playing surface, said wedge element having a male interlocking element at each of a first end and a second end of said wedge element; a gap element having a surface defining a space therethrough, said space at least as large as a golf ball, said gap element having a male interlocking element at each of a first end and a second end of said gap element; a wall element having two rectangular faces of like length substantially forming a right angle at their intersection, said wall element having a male interlocking element at each of a first end and a second end of said wall element; wherein each male interlocking element conforms to a common male configuration and each receiving socket conforms to a common receiving socket configuration in which any male interlocking element may be received into any receiving socket.

In some aspects, the embodiments described herein relate to a modular miniature golf course obstacle kit including two ramp elements.

In some aspects, the embodiments described herein relate to a modular miniature golf course obstacle kit wherein said ramp element further includes an interior storage space and the back of said ramp element defines an opening into said interior storage space.

In some aspects, the embodiments described herein relate to a modular miniature golf course obstacle kit wherein said common male configuration is T-shaped and said common receiving socket configuration is shaped to receive and interlock with any male interlocking element.

In some aspects, the embodiments described herein relate to a modular miniature golf course obstacle kit including a first set of wedges, walls, and gap having a first length and a second set of wedges, walls, and gap having a second length not equal to the first length.

In some aspects, the embodiments described herein relate to a modular miniature golf course obstacle kit wherein the plurality of base receiving sockets are two disposed adjacent to each side and four disposed to the back, the plurality of vertical receiving sockets are two disposed on each side adjacent to the back, and the plurality of top level receiving sockets are four.

In some aspects, the embodiments described herein relate to a modular miniature golf course obstacle kit wherein a slope of the incline surface is approximately 0.52.

In some aspects, the embodiments described herein relate to a modular miniature golf course obstacle kit wherein a slope of the wedge element is approximately 0.6.

In some aspects, the embodiments described herein relate to a modular miniature golf course obstacle kit wherein the incline surface includes an inclined planar surface.

In some aspects, the embodiments described herein relate to a modular miniature golf course obstacle kit wherein each curb tapers from a first height above the incline surface at the top level edge to zero at the base edge.

BRIEF DESCRIPTION OF THE DRAWINGS

The accompanying drawings, which are included to provide a further understanding of the disclosed subject matter, are incorporated in, and constitute a part of this specification. The drawings illustrate an exemplary embodiment of the disclosed invention and together with the detailed description, serve to demonstrate the fundamental principles of said invention.

Further embodiments, features, and advantages of the present invention, as well as the operation of the various embodiments of the present invention, are described below with reference to the accompanying drawings.

DETAILED DESCRIPTION

A preferred embodiment of the present invention is now described with reference to the figures, where like reference numbers indicate identical or functionally similar elements. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other systems and applications.

The present invention is fundamentally different from existing mini golf systems, as its pieces interlock in order to create a variety of configurations. This fills a gap in the market as the hole created is more than a simple putting green and has pieces that are connectable, rather than having stand-alone unconnected pieces.

An aim of the invention is to allow a user to build his/her own miniature golf hole at home using interconnecting pieces and obstacles, encouraging creativity through limitless combinations.

The invention may be embodied as various kits, each consisting of some number of pieces which interlock through one or more connecting mechanisms. The kits may represent different themes and allow a user to build his/her own configuration.

Within each kit, there may be a mat that serves as the starting point or tee, and a hole that serves as the end point. It will also contain various pieces in order to create a fun and challenging design. There may be some number of wedge pieces, some number of ramp pieces, some number of wall pieces, some number of bridge pieces, and some number of gap pieces, for example and without limitation. When put together, these pieces can represent a flexible design, with the ability to form multiple configurations for use. Pieces can be made of materials including, but not limited to, wood, foam, plastic, fiberglass, sheet metal, etc.

These pieces could interlock by any of a variety of means including, but not limited to, slide in connectors, screws, snaps, velcro, puzzle piece edges, magnets, etc. This can create structures that can be rigid or flexible, while maintaining the designed shape and configuration of the user's choice. Pieces feature a common interlocking mechanism making parts interchangeable and interconnectable.

Various kits that may embody this invention may have an overall theme which could also dictate what type of pieces are contained. For example, there could be a "tree" focused kit with obstacles representative of things made from wood-trees, ramps, bridges, etc., a "water" focused kit with obstacle designs representative of water features such as, waves, rounded mounts, swirls, banks, etc., or a "sand" focused kit with obstacle designs representative of sand traps, textured terrain, lumpy portions, etc.

Figure 1:
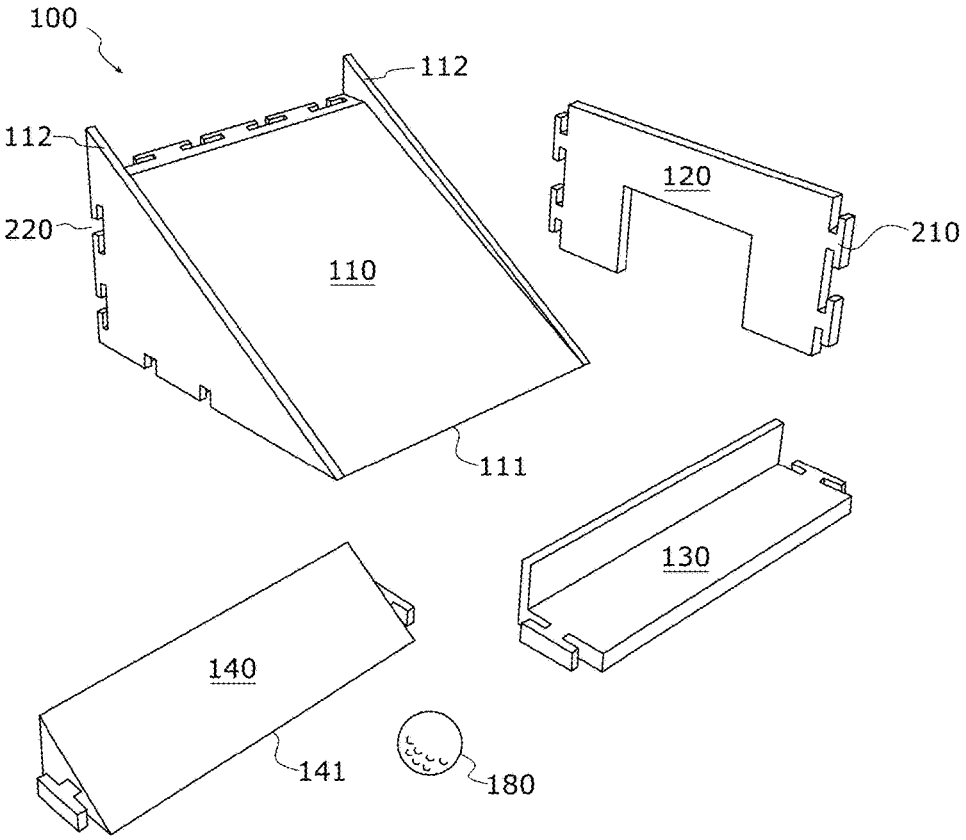
FIG. 1 illustrates a perspective view of component elements of an exemplary embodiment of a modular mini-golf course obstacle kit.

With reference to FIG. 1 illustrating a perspective view of kit 100 component elements of an exemplary embodiment of the invention, there may be various obstacles-optionally representative of some theme. Within kit 100, there are some number of various pieces and obstacles, such as but not limited to, some number of ramps 110, some number of gaps or bridges 120, some number of walls 130, and some number of wedges 140. Gaps 120, wedges 140, and walls 130 may include one or more male interlocking elements 210 for interlocking with a receiving socket 220 on a ramp 110. Male interlocking elements 210 and receiving sockets 220 may be generally "T"-shaped. The elements of kit 100 may be assembled into a user's unique mini golf hole design. Kit 100 may optionally include one or more golf balls 180. Kit 100 is portable, allowing the user to take it wherever he/she chooses, and may therefore be set up at home or at another location.

Ramp elements 110 include an incline base edge 111. When a ramp 110 is disposed on a mini-golf playing surface such as a floor or ground, incline base edge 111 contacts the surface, thereby permitting a golf ball 180 having sufficient transverse momentum to roll up ramp 110 from the surface without a hop or pop that would occur from the ball hitting a curb-type or thick obstacle edge. Similarly wedge elements 140 include a wedge base edge 141 so that when a wedge 140 is placed on a surface, wedge base edge 141 contacts the surface thereby permitting a golf ball 180 having sufficient transverse momentum to roll up wedge 140 from the surface.

In some embodiments, the inclined playing surface of ramp 110 is an inclined plane having a slope of approximately 0.52. In some embodiments, the inclined playing surface of wedge 140 is an inclined plane having a slope of approximately 0.6.

In some embodiments, ramp 110 includes one or two curbs 112 disposed on a side edge of the inclined surface of ramp 110. A curb 112 can function to inhibit a golf ball 180 from rolling off the side edge and can be used by a skilled user for bank shots. With reference to FIG. 2B, ramp 110A has an opening, thereby providing access to storage space 115, in which other kit 100 components can be stored and transported.

Figure 2A:
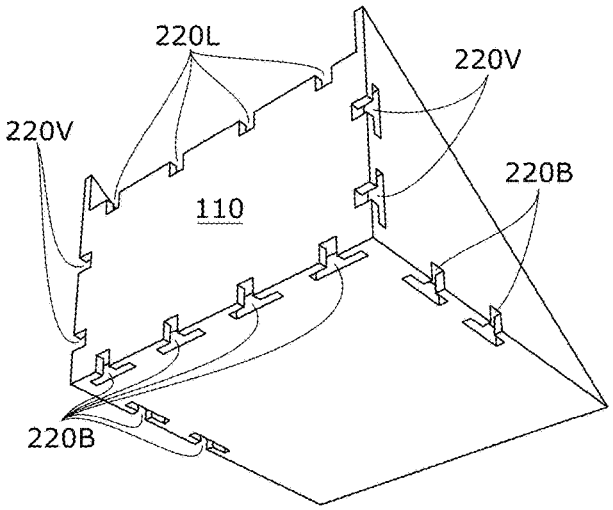
FIGS. 2A and 2B illustrate a bottom perspective view of exemplary ramp elements in accordance with embodiments of the invention.
Figure 2B:
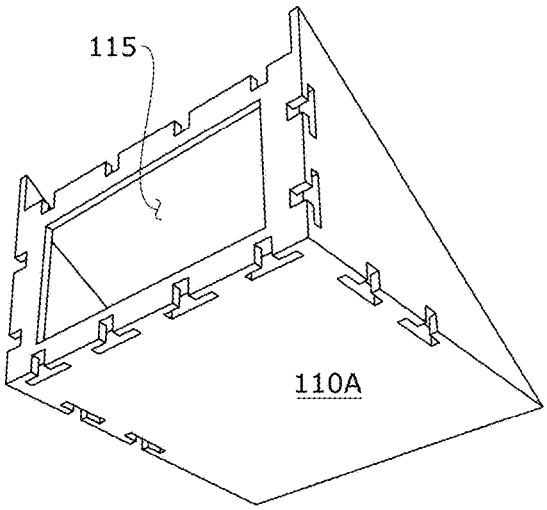

FIGS. 2A and 2B respectively illustrate bottom perspective views of exemplary ramp elements 110 and 110A. A ramp 110 may include one or more base receiving sockets 220B, permitting connection of other elements at the base of ramp 110. A ramp 110 may include one or more vertical receiving sockets 220V, permitting connection of other elements along a vertical edge of ramp 110. A ramp 110 may include one or more top level receiving sockets 220L, permitting connection of other elements along a top level edge of ramp 110.

Figure 3A:
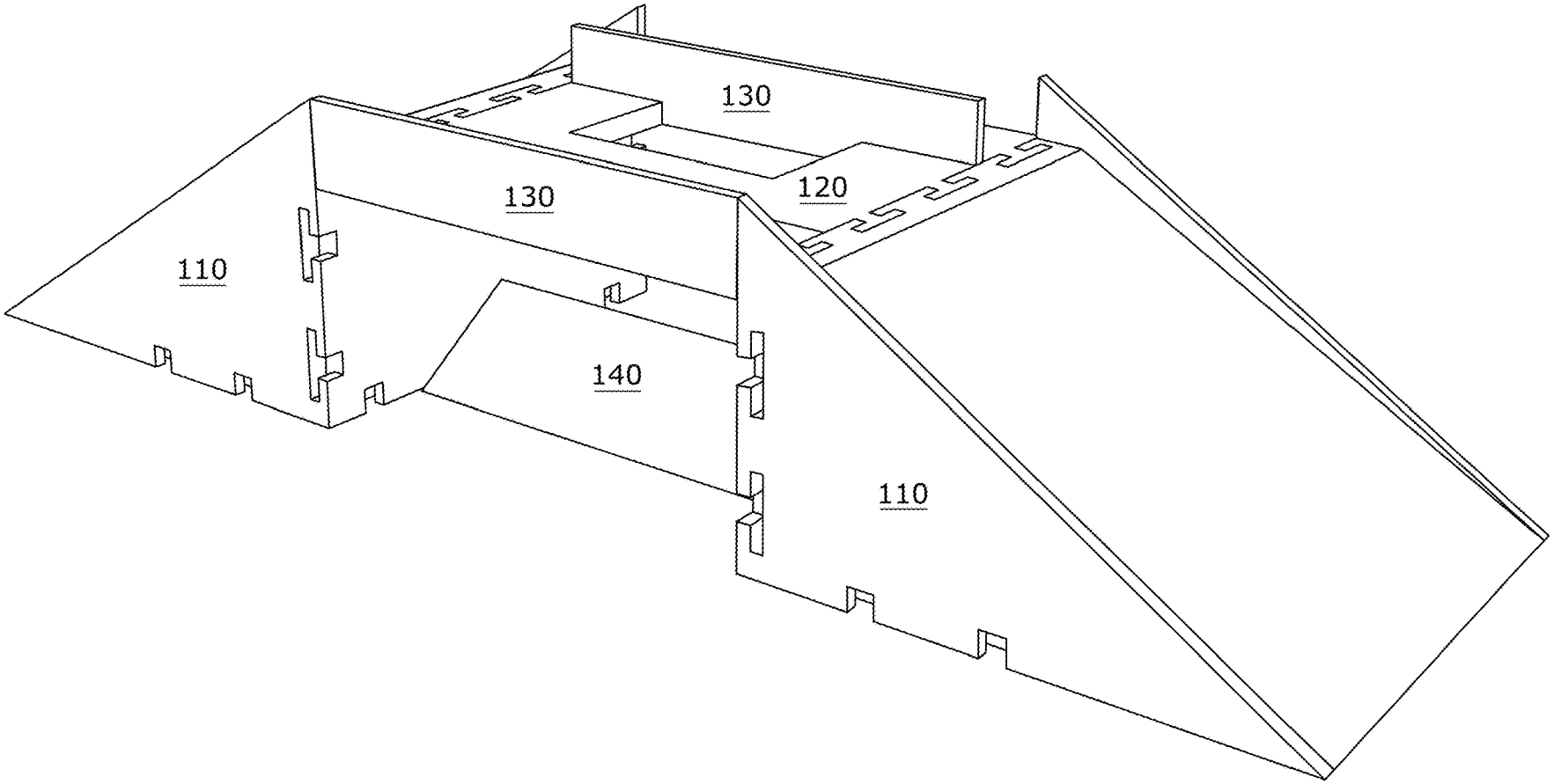
FIGS. 3A and 3B respectively illustrate upper and bottom perspective views of an exemplary assemblage of an embodiment of a modular mini-golf course obstacle kit in accordance with the invention.
Figure 3B:
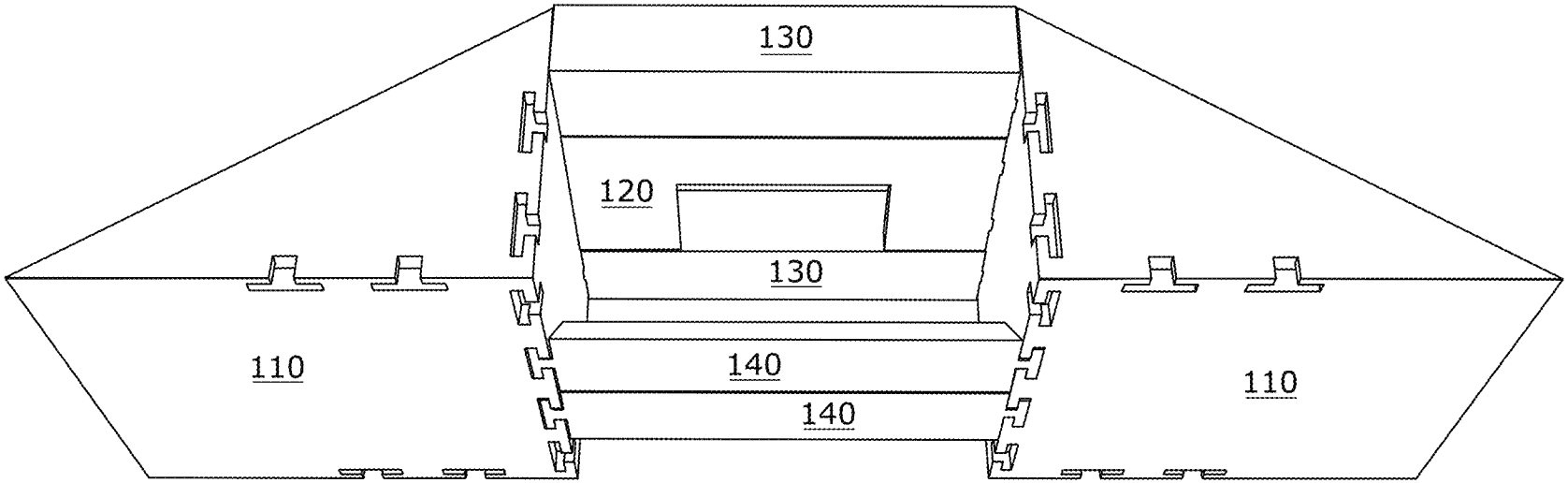

FIGS. 3A and 3B respectively illustrate upper and bottom perspective views of an exemplary assemblage of an embodiment of a kit 100. In this assemblage, two ramps 110 are connected back-to-back by several other elements including wedges 140 attached at the base of ramps 110, permitting up-and-over ball play over the wedges 140 and between the ramps 110. Additionally, ramps 110 are connected at top level by walls 130 and gap 120. This configuration creates a challenging ball play to shoot the ball up one of the ramps and across the bridge formed by walls 130 and gap 120 without going off the far edge of the bridge or falling through space 121 created by the gap 120. Alternatively, falling through space 121 created by the gap 120 might be the objective of the ball play.

Figure 4A:
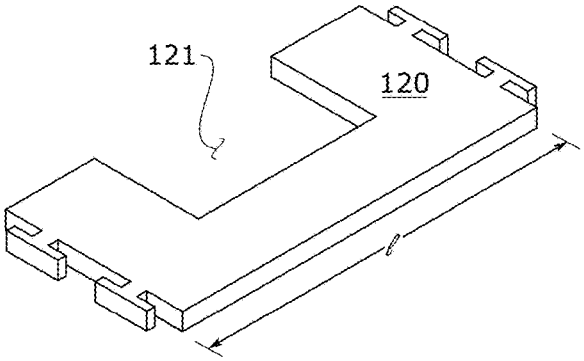
FIGS. 4A and 4B illustrate perspective views of exemplary gap elements in accordance with embodiments of the invention.
Figure 4B:
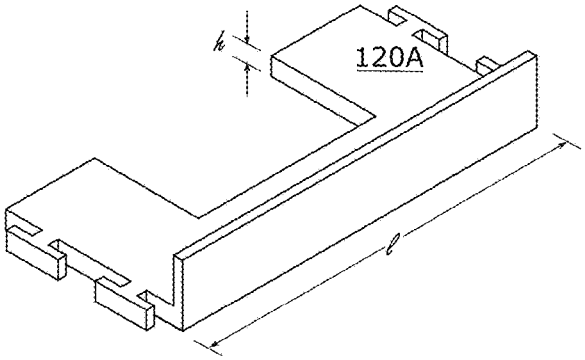

FIGS. 4A and 4B illustrate perspective views of exemplary gap elements 120 and 120A in accordance with embodiments of the invention. Gap element 120 defines a space 121, through which a golf ball may travel. When gap element 120 is oriented vertically, e.g., by attachment to ramp 110 via vertical receiving sockets 220V, the ball can roll on the playing surface through space 121 as a doorway. When gap element 120 is oriented horizontally, e.g., by attachment to ramp 110 via top level receiving sockets 220L, the ball can fall through space 121 as a hole or hazard.

Figure 5:
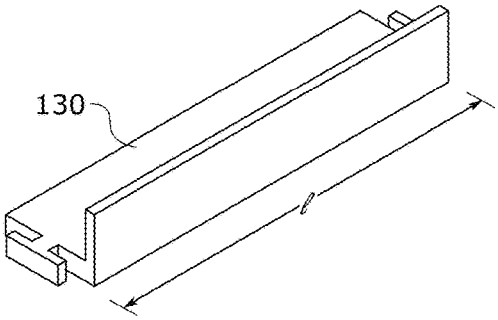
FIGS. 5 and 6 respectively illustrate perspective views of a wall element and wedge element in accordance with embodiments of the invention.
Figure 6:
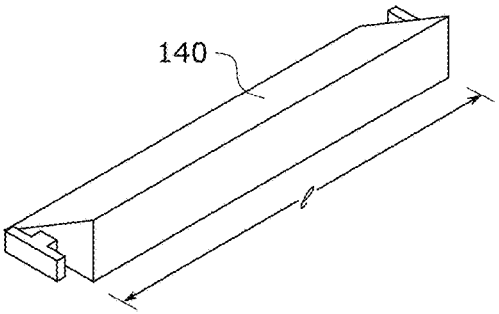

FIGS. 5 and 6 respectively illustrate perspective views of a wall element 130 and wedge element 140 in accordance with embodiments of the invention. Wall 130 and wedge 140 may be oriented upside down for game play, including to create a bridge surface from a first ramp 110 to a second ramp 110 when wedge 140 and/or wall 130 are socketed in the top level receiving sockets 220L of ramps 110. See FIG. 3B for illustration of bottom surfaces of wedge 140 and wall 130.

It should be noted that in some kit 100 embodiments, gap 120, gap 120A, wall 130, and wedge 140 may have a common dimensional length l. In other embodiments, kit 100 may include a set of gap, wall, and wedge elements of length/and another set of gap, wall, and wedge elements of length K where K #l. In some embodiments, elements may have a general thickness h of about 10 mm, including thickness of connecting elements 210.

Elements manufactured by injection plastic molding or 3D printing techniques are contemplated to be within the scope of this invention.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

What is claimed is:

1. A modular miniature golf course obstacle kit for assembly on a playing surface comprising:

a ramp element generally of prism shape having:

an incline surface having a top level edge, a first side edge, a second side edge, and a base edge for contacting with the playing surface, a back, a base, oppositely disposed sides, a plurality of base receiving sockets disposed in the base adjacent to each side and to the back, a plurality of vertical receiving sockets disposed on each side adjacent to the back, a plurality of top level receiving sockets disposed at the top level edge adjacent to the back, a curb along the first side edge, and a curb along the second side edge;

a wedge element generally of prism shape smaller than the ramp element and having a base edge for contacting with the playing surface, said wedge element having a male interlocking element at each of a first end and a second end of said wedge element;

a gap element having a surface defining a space therethrough, said space at least as large as a golf ball, said gap element having a male interlocking element at each of a first end and a second end of said gap element; and a wall element having two rectangular faces of like length substantially forming a right angle at their intersection, said wall element having a male interlocking element at each of a first end and a second end of said wall element;

wherein each male interlocking element conforms to a common male configuration and each receiving socket conforms to a common receiving socket configuration in which any male interlocking element may be received into any receiving socket.

2. The modular miniature golf course obstacle kit of claim 1 comprising two ramp elements.

3. The modular miniature golf course obstacle kit of claim 1 wherein the plurality of base receiving sockets are two disposed adjacent to each side and four disposed to the back, the plurality of vertical receiving sockets are two disposed on each side adjacent to the back, and the plurality of top level receiving sockets are four.

4. The modular miniature golf course obstacle kit of claim 1 wherein said ramp element further comprises an interior storage space and the back of said ramp element defines an opening into said interior storage space.

5. The modular miniature golf course obstacle kit of claim 1 wherein said common male configuration is T-shaped and said common receiving socket configuration is shaped to receive and interlock with any male interlocking element.

6. The modular miniature golf course obstacle kit of claim 2 comprising a first set of wedges, walls, and gap having a first length and a second set of wedges, walls, and gap having a second length not equal to the first length.

7. The modular miniature golf course obstacle kit of claim 1 wherein a slope of the incline surface is approximately 0.52.

8. The modular miniature golf course obstacle kit of claim 1 wherein a slope of the wedge element is approximately 0.6.

9. The modular miniature golf course obstacle kit of claim 1 wherein the incline surface includes an inclined planar surface.

10. The modular miniature golf course obstacle kit of claim 1 wherein each curb tapers from a first height above the incline surface at the top level edge to zero at the base edge.

* * * * *